US006185787B1

(12) United States Patent
Waeber et al.

(10) Patent No.: US 6,185,787 B1
(45) **Date of Patent: *Feb. 13, 2001**

(54) FIBER FLOCK CLEANER

(75) Inventors: René Waeber, Winterthur; Christian Sauter, Flurlingen; Jürg Faas, Andelfingen, all of (CH); Peter Netzhammer, Klettgau (DE)

(73) Assignee: Maschinenfabrik Rieter AG, Winterthur (CH)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/127,068

(22) Filed: Jul. 30, 1998

(30) Foreign Application Priority Data

Jul. 30, 1997 (CH) ..... 1819/97
Jul. 30, 1997 (CH) ..... 1820/97

(51) Int. Cl.[7] ..... D01G 15/40
(52) U.S. Cl. ..... 19/105; 19/98; 19/200
(58) Field of Search ..... 19/39, 105, 200, 19/204, 205, 98, 100, 107, 108, 109

(56) References Cited

U.S. PATENT DOCUMENTS

| | | | | |
|---|---|---|---|---|
| 3,470,588 | | 10/1969 | Just . | |
| 3,854,170 | | 12/1974 | Caughlin . | |
| 4,314,387 | | 2/1982 | Löffler . | |
| 4,345,356 | | 8/1982 | Handschuch et al. . | |
| 4,379,357 | * | 4/1983 | Beneke et al. | 19/105 |
| 4,472,859 | | 9/1984 | Elliott et al. . | |
| 4,507,827 | | 4/1985 | Staehli . | |
| 4,528,725 | * | 7/1985 | Horn et al. | 19/39 |
| 4,535,511 | | 8/1985 | Leifeld et al. . | |
| 4,731,909 | | 3/1988 | Duda . | |
| 4,734,957 | * | 4/1988 | Lenzen | 19/105 |
| 4,805,266 | * | 2/1989 | Leifeld et al. | 19/105 |
| 4,811,463 | * | 3/1989 | Leifeld | 19/105 |
| 4,928,355 | | 5/1990 | Leifeld . | |

(List continued on next page.)

FOREIGN PATENT DOCUMENTS

| | | |
|---|---|---|
| 2532061 | 2/1977 | (DE) . |
| 2804413 | 8/1979 | (DE) . |
| 3504607C2 | 8/1986 | (DE) . |
| 3528853C2 | 8/1986 | (DE) . |
| 3530327C2 | 3/1987 | (DE) . |
| 3733632A1 | 4/1989 | (DE) . |
| 4038838 A1 | 7/1991 | (DE) . |
| 4434250A1 | 3/1996 | (DE) . |
| 366692 | 1/1989 | (EP) . |
| 0340458 | 11/1989 | (EP) . |
| 0366918B1 | 5/1990 | (EP) . |
| 0583219B1 | 1/1996 | (EP) . |
| 0801158A1 | 10/1997 | (EP) . |
| 0810309A1 | 12/1997 | (EP) . |
| 1545928 | 5/1979 | (GB) . |
| 2245604 | 1/1992 | (GB) . |
| 2271126 | 4/1994 | (GB) . |
| 2289693 | 11/1995 | (GB) . |
| 9012909 | 11/1990 | (WO) . |

OTHER PUBLICATIONS

EPO SEARCH REPORT, MAR. 7, 2000.

* cited by examiner

*Primary Examiner*—Michael A. Neas
*Assistant Examiner*—Gary L. Welch
(74) *Attorney, Agent, or Firm*—Dority & Mannning, P.A.

(57) ABSTRACT

In a plant for processing textile fibers, the fine cleaning is effected at a point at which the stream of fiber material already has been subdivided (e.g. for the subsequent carding process), e.g. in the card filling chute. The cleaning device comprises at least one separating element arranged above the transporting roll. The trash eliminating system includes a system for eliminating material separated from the zone of the roll.

11 Claims, 5 Drawing Sheets

U.S. PATENT DOCUMENTS

| | | | | |
|---|---|---|---|---|
| 4,939,815 | | 7/1990 | Leifeld . | |
| 5,121,523 | | 6/1992 | Brutsch et al. . | |
| 5,123,145 | | 6/1992 | Schelb et al. . | |
| 5,146,652 | | 9/1992 | Leifeld . | |
| 5,181,295 | | 1/1993 | Demuth et al. . | |
| 5,197,162 | | 3/1993 | Pinto et al. . | |
| 5,228,171 | * | 7/1993 | Leifeld | 19/105 |
| 5,247,721 | | 9/1993 | Demuth et al. . | |
| 5,255,415 | * | 10/1993 | Leifeld et al. | 19/107 |
| 5,257,438 | | 11/1993 | Faas et al. . | |
| 5,303,455 | * | 4/1994 | Leifeld | 19/105 |
| 5,471,710 | | 12/1995 | Demuth et al. . | |
| 5,530,994 | | 7/1996 | Loeffler . | |
| 5,623,749 | | 4/1997 | Leifeld et al. . | |
| 5,737,806 | * | 4/1998 | Leifeld et al. | 19/98 |

FIBER FLOCK CLEANER

BACKGROUND OF THE INVENTION

The present invention concerns a cleaner for fiber material. The present invention is applicable in particular, but not exclusively, for plants for processing cotton or fibers of similar staple length.

The state of the art most closely related is described in the following and to be compared to the present invention. A more detailed description thus can be dispensed with here.

The goal of the present invention is to further develop the principles laid down in EP-A-810309 (and in U.S. Ser. No. 08/856,866 dated May 15th, 1997, respectively). Solutions achieving this goal are described in the present description.

Several embodiments according to the present invention are described in more detail in the following with reference to the illustrations shown in the Figures.

DETAILED DESCRIPTION

Figure 1:
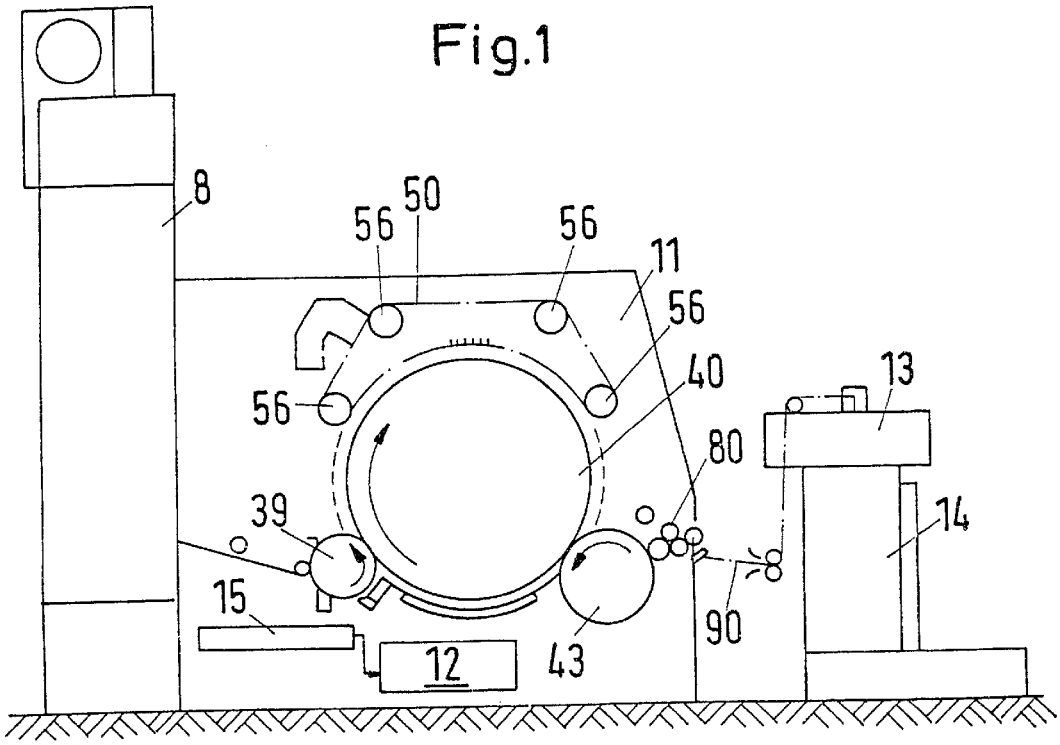
FIG. 1: a copy of the FIG. 1 from EP-A-801158.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a third embodiment. It is intended that the present invention include such modifications and variations as come within the scope and spirit of the present invention.

In the FIG. 1 a revolving flat card known as such, e.g. the card C50 produced by the present assignee, is shown schematically. The fiber material supplied by the fiber flock supply system is feed to the filling chute 8 in the form of fiber flocks, is taken over by a licker-in 39 (also called taker-in) in the form of a batt, is transferred to a drum 40 (also called cylinder) and, owing to the co-operation of the drum 40 with a set of revolving flats 50, is opened and cleaned further. The flats of the set of revolving flats 50 are guided along a closed path (in the direction of the rotation of the drum or in the opposite direction) via deflection rolls 56. Fibers from the web formed on the drum 40 are taken off by a take-off roll 43 and, in a delivery arrangement consisting of a plurality of rolls, are formed into a fiber sliver 90. This carded sliver 90 is deposited by a coiler device 13 in cycloid windings into a transporting can 14. The card 11 is provided with its own control system 12 which can be programmed, as well as a suitable "user interface" 15 (e.g. a key board and a display respectively) for the data input and/or the output of status reports.

In the FIG. 2 the card 11 again is shown with the filling chute 8 co-ordinated to it. The latter comprises an upper portion (infeed chute) 31 and a lower portion (reserve chute) 34. Fiber flocks from the lower chute portion 34 are taken off by two transporting rolls 35 in the form of the batt 9 mentioned above and are transferred to the feed roll 37 of the card 11.

Between the upper chute portion 31 and the lower chute portion 34 a feed device 32 is arranged which feeds the fiber flocks to an opening roll 33. Devices of this type generally are well known. According to the invention described in EP-A-810309, cleaning elements are to be provided at the opening roll 33 as to form a cleaning module which makes feasible substantial changes in the preceding plant arrangements. In principle, the feed device 32 and the opening roll 33 together with the neighboring portion of the chute housing are transformed in such a manner that they form a "fine cleaner".

The adaptation requires provision of elements on the circumference of the roll 33 permitting the elimination of trash. In the FIG. 2, grid bars 102 with free room (not indicated specifically) provided between them are shown schematically. The free room permits elimination of the waste into a collecting room 103 which can be connected with a suction system (not shown) for eliminating the material separated. The connection can be effected permanently, or preferentially, intermittently.

The feed device 32 represents a "nip feed" for the opening roll 33 as will be explained in more detail in the following with reference to the FIGS. 4A and 4B. This nip feed consists of a feed roll 321 and a trough 322. Many other types of feed devices of similar types are known, however, as can be seen from e.g. EP-A-383 246, or EP-A-470 577 respectively, which also can be applied in the new cleaning point. In the preferred arrangement, shown schematically in the FIG. 4A, the nip feed is laid out as a kind of a "metering device" according to EP-A-383 246. This, however, does not represent an essential characteristic of the present invention.

In DE-A-25 32 061, a method is described for de-dusting of fiber material to be spun and a device for feeding de-dusted fiber material to cards. Of particular interest therein was the elimination of "fine dust", such dust exerting a particularly detrimental influence in the rotor spinning process. A de-dusting action thus was aimed at, which together with an additional cleaning step was to be effected intensely and using simple means. For this purpose, the fiber material should be substantially opened upstream from a card or a roller card down to the individual fiber and the dust, including the micro-dust, adhering to the fiber material or being freed should be eliminated pneumatically. The corresponding apparatus according to DE-A-25 32 061 comprises a rotating sieve drum arranged immediately subsequent to an opening roll and connected to a suction system. For co-operation with the fact rotating opening roll cleaning grids and/or guide plates were provided for effecting the dust elimination process. Subsequent to the sieve drum, a feed chute for a card could be arranged. In the design example according to DE-A-25 32 061, a chamber was provided below the opening roll in which arrangement a cleaning grid arranged at about mid-height of the opening roll serves for eliminating coarse impurities and in which the lower portion of the chamber is taking up the impurities. Essential for the aggregate (page 7 of the description), was the fact that a device isolating the fiber material substantially down to the individual fiber was combined with a pneumatic suction device for eliminating the dust including the micro-dust.

Figure 2:
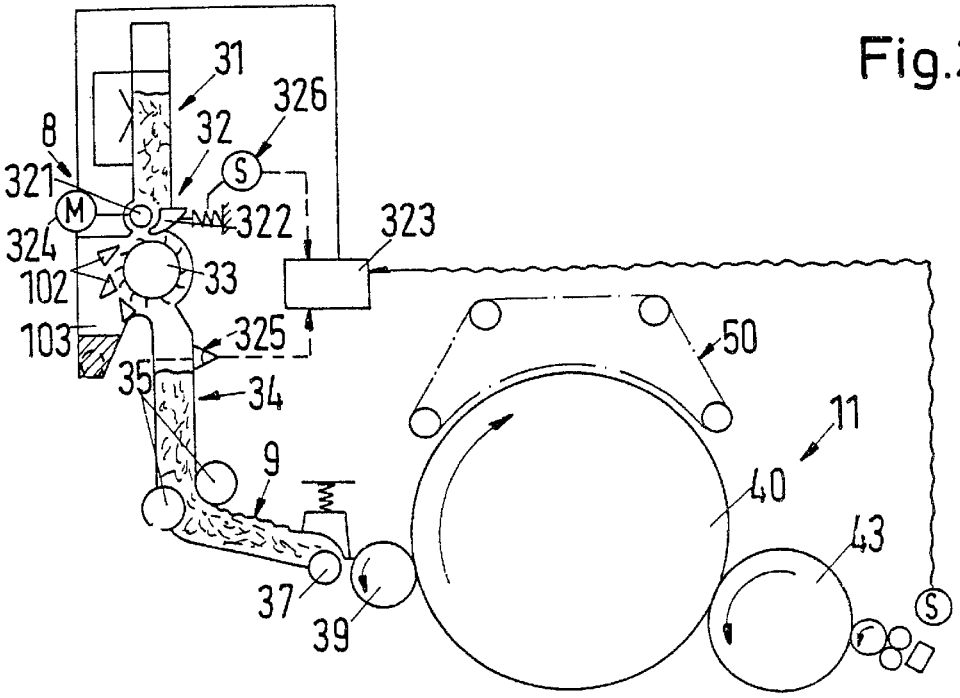
FIG. 2: a modification of the arrangement according to the FIG. 1, for establishing an apparatus according to EP-A-810309.
Figure 3A:
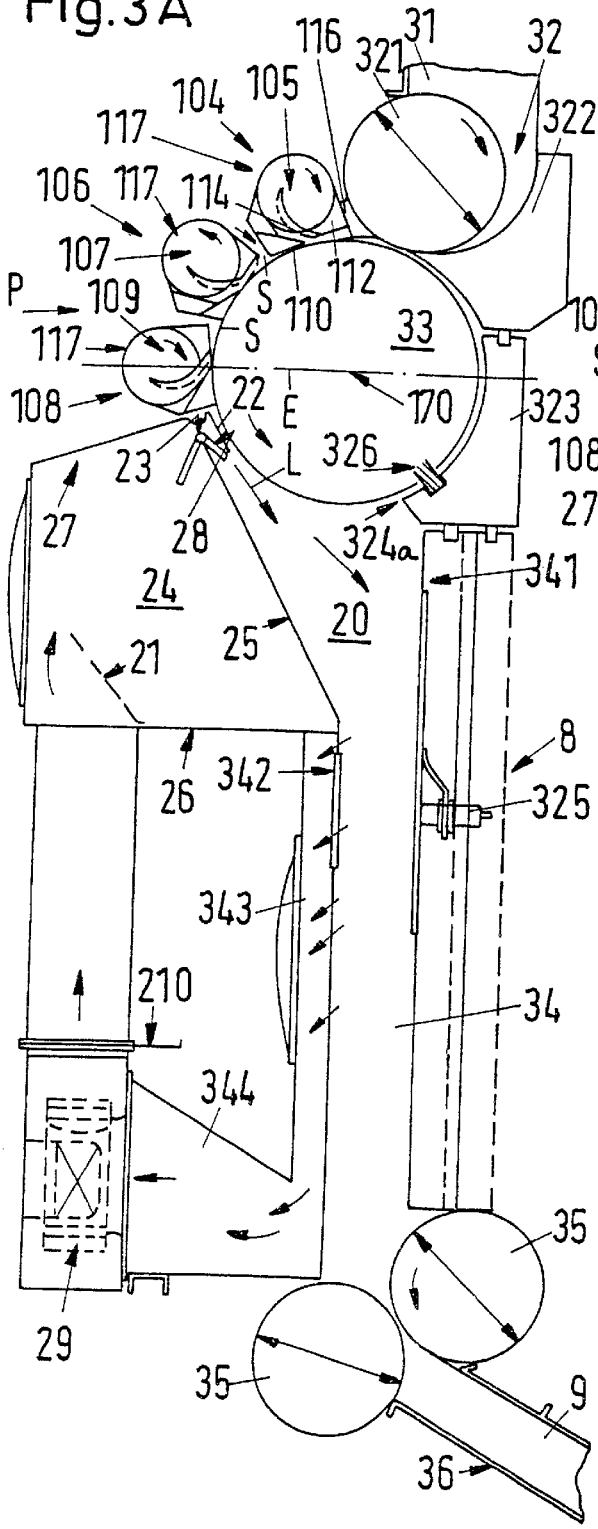
FIG. 3: a cross-section (FIG. 3A) and a side view (FIG. 3B) of an embodiment of a chute according to the present invention, selected elements according to the FIG. 3A being shown only.
FIG. 3C and FIG. 3D: a detail each of the arrangement according to the FIG. 3A, FIG. 4: in the FIG. 4A and FIG. 4B each a possible embodiment of the nip feed arrangement.
Figure 3B:
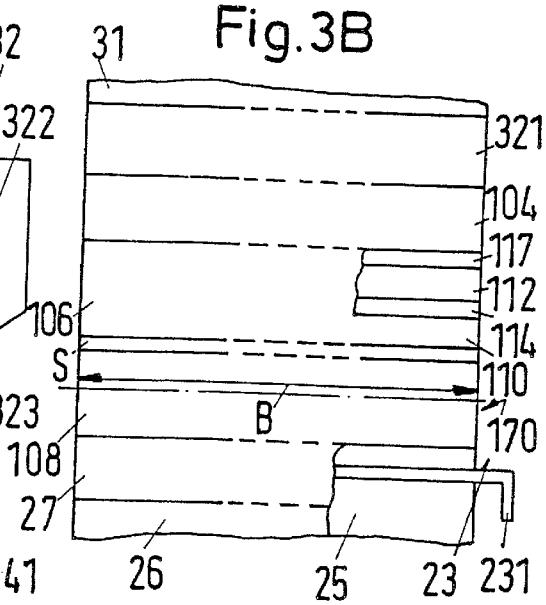

In the FIG. 3A, the essential elements of the new filling chute 8 are shown again a in cross-section, in particular the upper chute portion ("supply chute") 31, the lower chute portion("reserve chute") 34 with the transporting rolls 35, the material supply system 32 with the feed roll 321 and the feed trough 322, and the opening roll 33. The filling height level sensor 325 (compare the FIG. 2) also is shown in the FIG. 3A. The fiber batt 9 supplied by the rolls 35 according to the FIG. 3A is transferred via a duct 36 to the feed roll (not shown) of the card. The side view (FIG. 3B) shows the cleaning module of the same chute seen in the direction of the arrow P (FIG. 3A) with certain elements being shown cut away partially in the FIG. 3B in order to render visible the elements arranged below them. The length of the roll 33 determines the working width B of the machine. This working width can be 1 m to 2 m, preferentially from 1 m to 1.5 m. The supply system 32 is to supply fiber flocks as uniformly as possible over the working width B to the roll 33 and the material cleaned is to be distributed as uniformly as possible over the width of the chute 34. The rolls 321, 33 are rotatably supported in lateral walls (not shown). The direction of rotation of the roll 33 is indicated with the reference sign 170. The rotational directions each are indicated by arrows.

The opening roll 33 provided with a clothing here acts as a transporting roll moving the fiber material between the material supply system 32 and the batt forming device 34, 35. Seen in the direction of rotation of this transporting roll the "take-over point", at which the roll 33 takes over fiber material from the fiber beard presented by the supply system, is located at a short distance form where the transporting path reaches its highest point. In this respect the new arrangement differs from the solution principle according to the FIG. 2 as well as (and more distinctly so) from the state of the art according to DE-A-25 32 061. The new arrangement provides more space for the working elements to be described in the following. In contrast to the schematical solution according to the FIG. 2, the fiber material now is transferred past three elimination devices 104, 106, 108 and subsequently reaches a deflection zone 20 at the upper end of the lower chute portion 34. The eliminating devices 104, 106, 108 are laid out substantially identically in such a manner that the description of the device 104 can be considered valid also for the two other devices 106, 108. Each of the eliminating devices thus comprises an eliminating element 110 each and a guide element 112 arranged, seen in the direction of transport, immediately preceding the eliminating element. Between the guide element 112 and the eliminating element 110 co-ordinated to it the mouth of an eliminating gap 114 is present.

Each of the devices 104, 106, 108 preferentially can be adapted in its position relative to the transporting roll 33 in such a manner that the separation effect can be optimised, i.e. the eliminating elements 110 as well as the guide elements 112 are movable with respect to the transporting path defined by the transporting roll. This can be achieved by mounting each of the devices 104, 106, 108 pivotably in the lateral walls of the machine in such a manner that each device can be pivoted as a "unit" about a corresponding axis of rotation each 105, 107, 109 manually or by an actuator system as to adjust the angle setting of the corresponding elements 110, 112 with respect to the transporting roll. An actuator device can comprise a controllable drive system which, however, is not relevant for the present invention. The individual elements can be set individually, namely in different manners, e.g. in radial directions with respect to the axis 170, by pivoting them about their own pivoting axis, etc. The various elements determining the cleaning effect also could be set simultaneously (jointly) using a common actuator device. This possibility is not be discussed in more detail here, the general arrangement of the cleaning module being the main subject of the present application.

From the FIG. 3A it can be seen that the first separating device 104 is arranged in "immediate" vicinity of the feed roll 321. Between the feed roll 321 and this first separating device 104 only a guide rod 116 is provided which guides the material transported by the opening roll 33 into the working gap between the first guide element 112 and the transporting roll. A small clearance s each also is provided between a preceding device 104, or 106 respectively, and the subsequent device 106, or 108 respectively. The leading edge of the last separating element 110 thus is arranged in a substantially horizontal plane E which contains the rotational axis of the roll 33. This "geometry" of the lay-out is not necessarily required. The "plane E" could be shifted further in the direction of rotation of the roll 33 in such a manner that it forms an angle of about 45° with the horizontal plane.

The cleaning action now at least partially is effected "above" the roll 33, i.e. above the horizontal plane E shown. Gravity correspondingly can assist neither the separation nor the elimination of trash. Each device 104, 106, 108 thus comprises its own trash elimination system which ensures that material separated by each corresponding element 110 is eliminated from the zone of the transporting path. The material to be eliminated moves in the mouth of the gap and in the gap portion adjacent to it in a direction extending about tangentially with respect to the roll 33. Preferably, however, this material is deflected as soon as possible into a direction extending roughly parallel to the rotational axis 170, at least until it reaches either side of the machine. Gravity not assisting, elimination of trash preferentially relies on suction action, and each device 104, 106, 108 preferentially is provided with its own suction tube 117 extending parallel to the axis 170 over the working width. Each suction tube 117 can be connected on one side of the machine to a common suction duct (not shown). The connection can be established according to the principles explained for the card in EP-B-340 458 and EP-B-583 219. An alternative arrangement can be seen in U.S. Pat. No. 5,255,415.

The separating devices thus can be laid out according to the principles already applied in separating undesirable materials at the main drum (or main cylinder) on the card. In the meantime many design variants according to such principles have become known and the ones listed in the following are considered as examples merely. These are:

EP-A-366 692: (Jacobsen) Air stream from the surrounding room.

EP-A-366 918: (Graf) Carding segment.

U.S. Pat. No. 4,314,387: (Hollingsworth) Adjustable knife blade.

U.S. Pat. No. 5,530,994: (Hollingsworth) Rounded knife blade.

A possible solution is described in the Swiss Patent Application EP 97810695.3 by the same assignee. The present invention, however, can be realized also under application of other means.

Figure 3C:
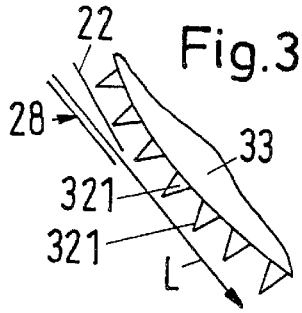

Using three separating devices 104, 106, 108 it is possible to achieve a sufficient degree of cleaning in the batt 9 supplied even if (according to EP-A-810309) in the blowroom no fine cleaning stage (with a nip feed) has been applied. Owing to the shift of the plane E mentioned above in the direction transport, room could be freed also for a fourth separating device. The fiber material (remaining after passing the leading edge of the last separating element 110) moving with the roll 33 thus can be prepared for the deflection, or for dropping into the reserve chute 34 respectively. For this purpose, the fiber material first is guided using a guide surface 22 into close vicinity of the circumferential surface of the roll 33 provided with clothing, in which arrangement the material stream tends to fly tangentially from the roll 33 in a direction sloped downward. The slop can be assisted by an air stream L which mingles with the stream of material (seen in the direction of transport) after the guide surface 22 and flows on in said tangential direction. The arrangement is shown more clearly in the FIG. 3C. The air flow L passes along the points 321 of the roll clothing, or possibly along the outer end portions of these points. Means for optimizing the direction of this flow are described in the following in more detail.

The stream of material thus to a large extent is taken off from the roll 33 and is guided into the material deflecting zone 20 converging downwards. In case individual flocks adhere to the clothing of the roll 33, the cover 323 of the roll 33 facing the cleaning module is provided with a knock-off, or clearing edge 324*a*, which can clear flocks protruding from the clothing and deflect them into the zone 20. The cover 323 can be designed as a hollow profile, e.g. an extruded profile. The corresponding section is arranged adjacent to the trough portion not designated with a reference sign which forms the trough 322. The latter element also can be designed as a hollow profile.

Figure 3D:
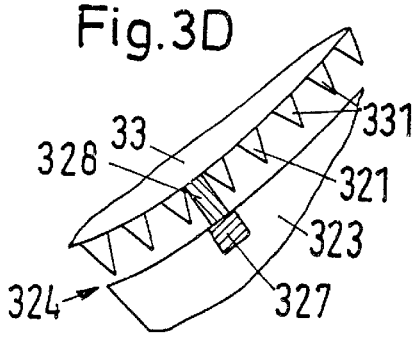

The cover 323 is provided with a brush 326 extending towards the inside by which individual fibers remaining on the clothing or squeezed into the clothing can be eliminated from the clothing and deflected into the zone 20 before the portion of the clothed working surface concerned returns back to the nip point of the feed system 32. The brush 326 comprises e.g. a support rod 327 (compare the detailed view in the FIG. 3D) taken up in a take-up groove provided in the cover 323 the rod being provided with bristles 328 protruding towards the inside. A brush of this type can be exchanged without problems from time to time with a replacement unit. The brush, however, does not serve primarily as a flock detaching element but rather as a seal of the gap between the roll 33 and the cover 323. In this arrangement, a pressure build-up is created upstream from the brush 326 which also assists deflection of the flock-air stream towards the lower chute portion 34.

The air stream mentioned before flows from a calming room 24 in a box 26 one wall 25 of which is disposed inclined in such a manner that it forms one side of the material deflection zone 20. The opposite side of this zone 20 as shown in the FIG. 3A is formed by a vertical wall portion 341 extending upward to the cover 323 and downward to one of the transporting rolls 35. An alternative arrangement is explained briefly in the following with reference to the FIG. 5. The wall portion 341 is provided with an opening for taking up the filling height sensor 325 but is not perforated and can be sealed against the cover 323 by means of a gasket. The air stream flowing into the chute portion 34 thus cannot escape from this chute side. The wall portion 341 can be movable relative to the cover 323 in such a manner that the "depth" of the chute portion 34 (in a horizontal direction at right angles to the working width) can be adapted.

The uppermost edge of the wall 25 is situated (seen from the axis 170) behind a plate forming the guide plate 22. At this wall edge a pivoting axis 23 is provided extending through the lateral machine walls (see FIG. 3B) and provided with at least one setting lever 231. The axis 23 supports a wing 28 which together with the plate mentioned above forms an inlet duct for the air stream L (compare also the FIG. 3C). The plate itself is fixedly mounted relative to the roll 33 and is formed e.g. by a bent lip at the upper wall 27 of the box 26. By pivoting the wing 28 the width and the direction of the air stream L laid out as a "curtain" can be influenced, and optimized respectively. The lever 231 can be operated manually or by a controlled actuation system.

The air stream L generated by a fan 28 flows via a flap 21 into the calming room 24. The air forming the air stream could be taken from the surrounding room. In the preferred solution, however, it is taken as re-circulated air from the chute portion 34, namely via holes (not shown specifically) in a wall portion 342, which in the design example according to the FIG. 3A extends vertically downward from the lower end of the wall 25 and is arranged opposite the wall portion 341. Many "perforated" walls have become known for application in a batt-forming chute and a more detailed description thus can be dispensed with here. In the preferred solution, the perforated wall is designed as a sieve wall in which arrangement the wall can be composed from elements (lamellae). Regardless of how the perforated wall is laid out, the air emerging from the chute portion 34 can be collected in a chamber 343 and be guided downward where it is carried on via an intermediate portion 344 to the fan 29. The air streaming via the fiber mass in the chute portion 34 serves for condensing the flocks stored therein which considerably improves the uniformity of the batt formed between the wall portions 341, 342 and thus also of the batt 9 delivered by the rolls 35.

The air quantity required can be determined empirically. The fan 29 preferentially is driven at constant rotational speed by a motor (not shown). The air quantity required can be adjusted by means of a throttle slide 210, or by suitably designing the flap 21.

In principle it is known from DE-C-2804413 that air can be passed through the lower chute portion of a filling chute in such a manner that the fiber mass (batt) stored therein is condensed. Additional proposals are shown in DE-B-3504607; DE-B-3528853; DE-B-3530327 and DE-A-4434250. In none of these known arrangements, the air guide arrangement is provided in combination with a cleaning module arranged in the fill chute.

In the FIG. 3A the preferred solution is shown in which the batt between the wall portions 341, 341 presents a certain weight (about 1 to 2 kg), the chute portion 34 thus serving as a material storage device, or buffer respectively. This aspect is not relevant for the present invention, however. An alternative solution is known e.g. from U.S. Pat. No. 5,623,749 according to which material is collected only at the lower end of the feed chute and is carried on practically immediately to the feed roll of the card. The present invention is applicable also in a design variant of this type of the batt-forming device.

The term "nip feed" within the context of the present description and of the patent claims is understood to signify "nip feed with subsequent cleaning functions" in which arrangement the elimination of material represents a significant characteristic of the cleaning functions.

Figure 4A:
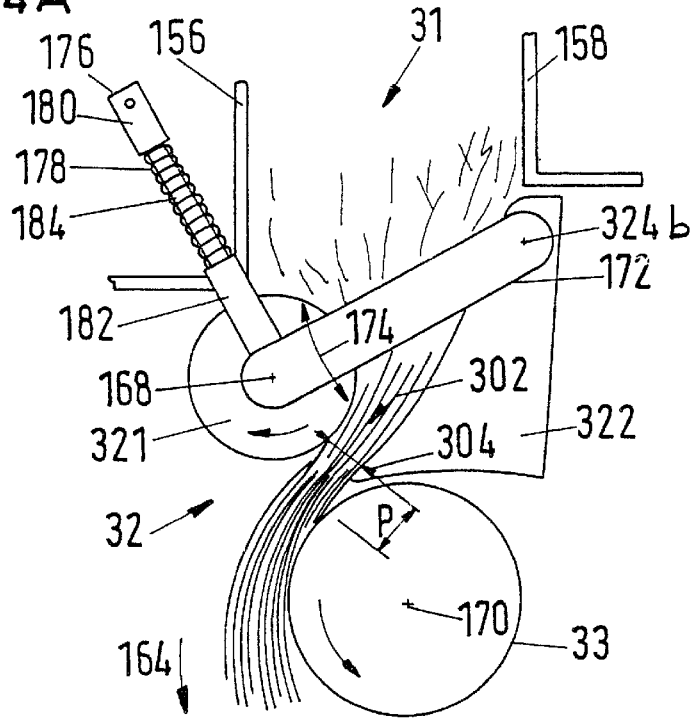

In the FIG. 4A a possible design example is shown schematically as an example of a supply system 32 with a nip feed which additionally is laid out as a metering device according to EP-B-383 246. In a card filling chute it possibly might prove sufficient if an air flow volume is metered (rather than a mass flow). In this case it is possible to dispense with special measures for maintaining the density of the material in the nip gap constant. In the FIG. 4B a simplified variant design example is shown (without a metering device). In the illustrations of the FIGS. 4A and 4B each the distance between the nip point and the fiber take-over point (in the sense of EP-A-419 415) is indicated with the reference sign "P". This distance in processing "short staple fibers" (cotton and chemical or man-made fibers of corresponding staple lengths) is chosen not larger than 100 mm and preferentially is chosen in the range of 14 mm to 40 mm. The "cleaning parameter" P can be rendered adjustable according to EP-A-419 415 in such a manner that the parameter can be adapted to the material to be processed. The parameter P can be rendered adjustable e.g. by means of a control device with a cleaning diagram according to EP-A-452 676.

The two lateral walls 156, 158 of the flock chute 31 shown in the FIG. 4A extend into close vicinity of the surfaces of the feed roll 321, and of the trough 322, respectively, and diverge slightly in such manner that no flock congestion occurs. The flocks in the chute 31 are taken over by the feed roll 321 rotating in the direction indicated by the arrow and are compressed into a flock batt in the transporting gap 302 between the feed roll 321 and the trough 322. The opening roll which is rotatable about a rotational axis 170 then frees the flocks from the flock batt and generates a flock stream which moves on in the direction indicated by the arrow 164. All flocks taken over by the feed roll which rotates at a rotational speed n (rpm) are transported through a transporting gap, the width 304 of which represents the smallest distance between the feed roll 321 and the trough 322, and the length of which corresponds to the length of the feed roll, and to the width of the lateral walls of the chute, respectively.

The feed roll 321 is rotatable in the direction of the arrow about its rotational axis 168, which at both ends is supported in a pivoting arm 172 each in which arrangement the two pivoting arms 172 (one of which only is visible in the FIG. 4A) are linked to the pivoting axis 324*b* arranged on the fixedly mounted feed trough 322. This mounting arrangement of the feed roll 320 permits an adaptation of the minimum width 304 if the pivoting arms are pivoted as indicated by the arrows 174. A pre-tensioning device 176 acts from above onto the lower end of the pivoting arms 172 and thus presses the feed roll in the direction towards the feed trough 322.

The pre-tensioning device 176 comprises a pre-tensioning spring 178 which with one of its ends rests against a fixed stop 180 provided on the filling chute and with its other end rests against a stop 182 connected to the arm 172. Between the stop 180 and the stop 182 a rod 184 extends which is movably arranged within the stop 182. It is understood that second pre-tensioning device 176 arranged at the opposite face side of the feed roll 321 exerts pressure onto the arm 172 co-ordinated to it. The two springs 178 thus tend to reduce the distance 304. The minimum distance 304 is pre-determined by a stop arrangement (not shown) which co-operates with the arm 172 shown. A further stop arrangement is provided at the other face side of the feed roll 321 and correspondingly co-operates with the arm 172 arranged there.

The distance 304 adjusts itself during operation according to the pressure prevailing in the transporting duct, the density and the degree of opening of the flocks and the force of the springs 178 in which arrangement the size of the distance 304 can be judged by the shifting movement of the rod 184 within the stop 182. The rod 184 and the stop 182 are laid out as a distance measuring device. The metering method and the control procedure applied have been explained in EP-C-470 577.

Figure 4B:
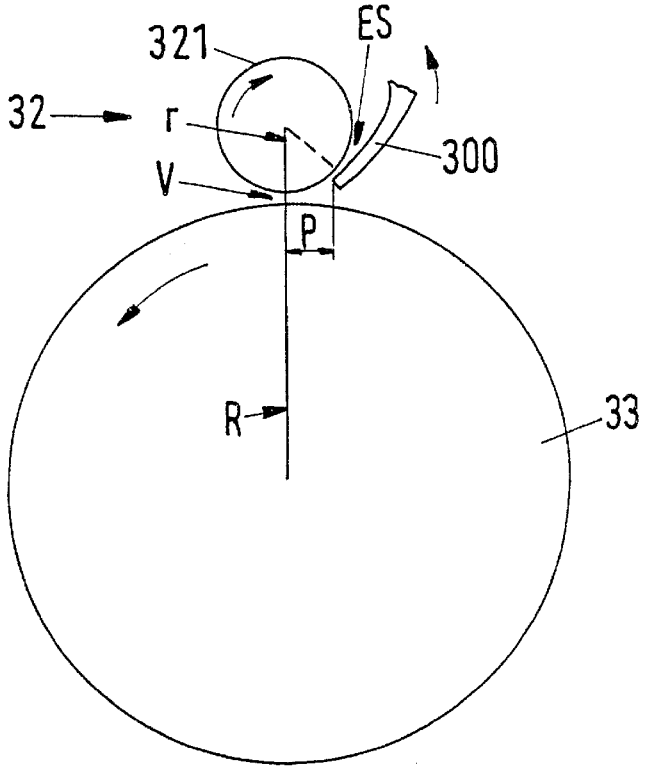

In the FIG. 4B an arrangement according to EP-A-419 415 is shown schematically with an opening roll 33 and a supply system 32 comprising a feed roll 321 and a feed trough 300. The directions of rotation of the rolls (indicated by arrows) result in a parallel feed, i.e. the fiber material is carried off by the roll 33 from the feed trough 300 and after being taken over by the roll 33 the material is not transported back between the trough 300 and the surface of the roll 321. The feed roll 321 is arranged relative to the roll 33 in such a manner that a condensing gap V is established in which the radius R of the roll 33 is in line with the radius r of the roll 321. This condensing gap V defines the "take-over point" at which the fiber material is taken over by the roll 33.

The feed trough 300 is arranged with respect to the feed roll 321 in such a manner that together they define a narrowest point ES. The distance "p" between the point ES and the condensing gap V according to EP-A-419 415 should be adapted to the staple length of the material to be processed. This is effected preferentially in that the trough 300 is set with respect to the roll 321 as indicated in the FIG. 4B by the double arrow. The position of the trough 300 preferentially can be set relative to the rotational axis of the roll 321 in such a manner that the angle of the radius line extending (indicated in dashed lines) through the narrowest point ES is changed with respect to the radius r.

FINE CLEANING

The design examples described all work according to the known principle that the fiber flow moves along a curved path while material is separated from the (radially) outermost layers. The degree of opening can be adapted to the cleaning function in such a manner that the impurities can "migrate" radially outwards in such a manner that impurities rather than usable fibers tend to be separated.

The fiber flow upon leaving these separating elements can be given off directly to the lower chute, no further treatment (e.g., on a sieve drum) nor transporting being required—such processing steps (the degree of opening being enhanced owing to the fine cleaner) would result in nep formation.

In the preferred design example, the cleaning module in the filling chute comprises an opening roll 33 know as such. Cleaning devices are known also (e.g., DE 40 39 773) comprising a "series of rolls", i.e. a plurality of rolls each provided with clothing and with at least one element which eliminates impurities from the material flow. "Multi-roll cleaners" of this type also can be applied in a "cleaner-chute" according to the present invention but they do not offer substantial advantages over the device variant equipped with one roll according to the preferred solution.

The arrangement according to the FIG. 2, and the FIG. 3, respectively, is of conventional design insofar as the transfer of the batt form the chute to the card is concerned. The new cleaning point according to the present invention, however, is applicable also in other arrangements in which e.g. the chute 8 is connected to the card 11 in such a manner that the intermediate rolls 35 can be dispensed with. Arrangements of this type are shown e.g. in DE-A-37 33 631, DE-A-37 33 632 and DE-A-37 34 140. Also, a plurality of licker-ins 39 can be provided as proposed e.g. in DE-A-43 31 284.

The present invention also is not limited to applications in a revolving flat card. Also e.g. fixed flat cards are known (see DE-A-44 18 377) which could be provided with a filling chute each according to the present invention. The present invention also can be applied in combination with so-called roller cards used in processing long staple fibers.

Control of the new cleaning point according to the present invention preferentially is integrated into the control system of the chute as shown schematically in the FIG. 2. The control system normally comprises a control device 323 for a motor 324, the rotational speed of which can be controlled and which drives the feed roll 321. The control device 323 is connected to a filling height sensor 325, various sensor types being known (such as optical or pressure sensitive sensors) which can fulfill the task, a more detailed description thereof can be dispensed with. Using a suitable control algorithm, the filling height level in the lower chute portion 34 can be maintained within pre-determined tolerances. A sensor S also can be provided in the delivery zone and be connected to the control device 323 in such a manner that the production rate of the cleaning point can be adapted to the production rate of the card. An arrangement of this type (comprising a filling chute without a cleaning point) is known from DE-A-36 25 311 and from DE-A-32 44 619 (U.S. Pat. No. 4,535,511).

Also known according to the state of the art is a further alternative design solution which is indicated in the FIG. 2, in which a translation or force sensor 326 for transmitting its signals also is connected to the control device 323. The sensor 326 measures the distance over which the trough 322 moves, or the forces exerted onto it, and thus renders a king of "metering" feasible (e.g. according to EP-A-383 246).

It is now possible to control the card 11 and its feed system (feeding from the chute 8) as a "unit", for which purpose the control systems of both machines can be combined or interconnected. An arrangement of such type proves particularly advantageous in combination with the present invention as the cleaning actions effected by the card itself and by the cleaning point co-ordinated to it can be co-ordinated and mutually balanced, e.g. according to the "VARIOset" principle explained in EP-A-452 676 and amended in EP-A-801158.

Figure 5:
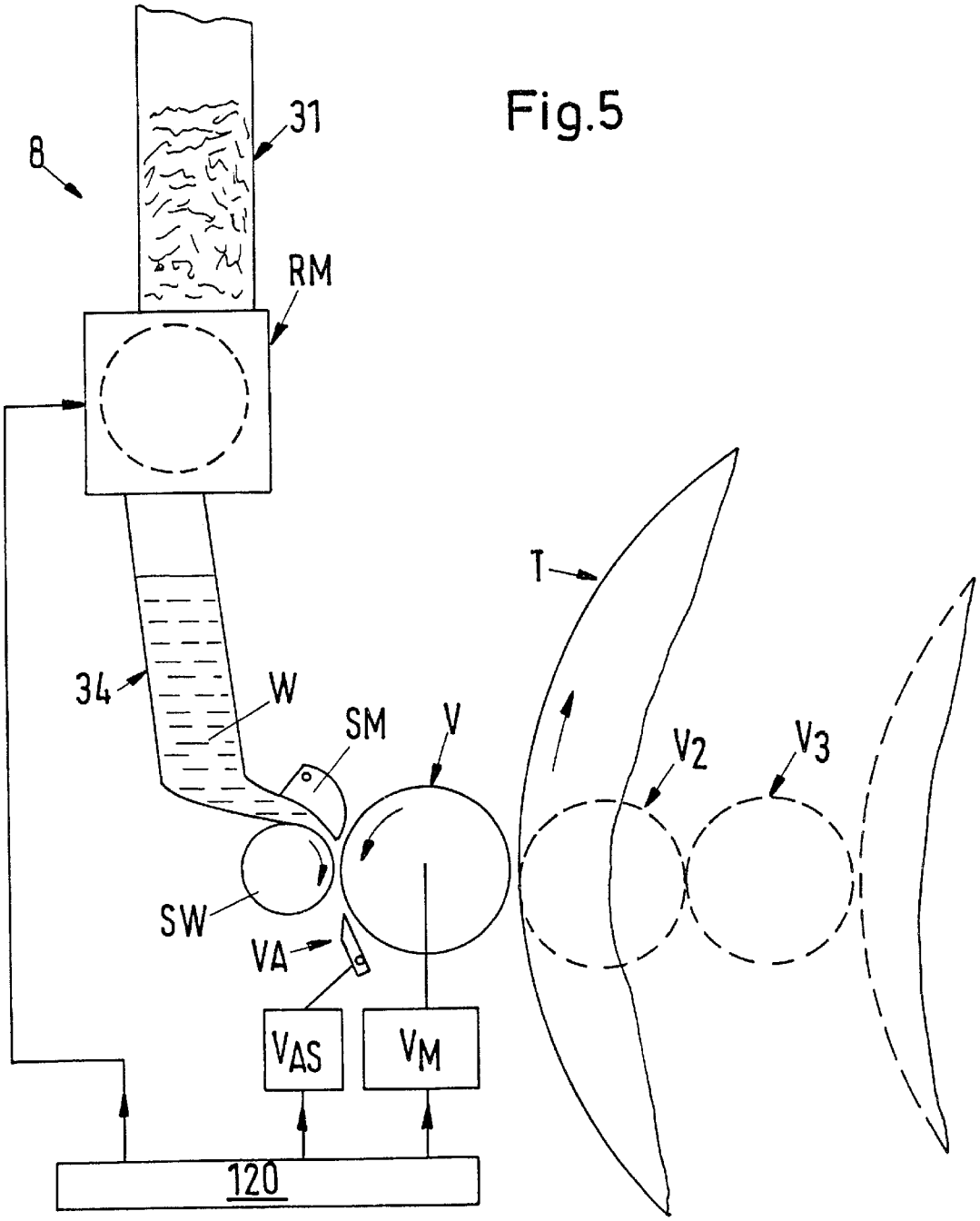
FIG. 5: the fiber supply system of a card with a chute according to the present invention.

In the FIG. 5 a feed chute 8 is shown schematically with a cleaning module RM according to the present invention. The lower portion 34 of the chute forms a fiber batt W from which fibers are transferred using a feed roll SW and a feed trough SM to a licker-in V. A plurality of licker-ins can be provided as indicated with circles V2 and V3 shown with dashed lines. The reference sign VM indicates a drive motor provided for the licker-in V (and for possible additionally provided licker-ins V2, V3). The reference sign VA indicated a separating element in the licker-in module, and the box VAS schematically indicates an actuator system for setting the element VA relative to the licker-in.

The licker-in V including the separating element also forms an opening and cleaning device, or a cleaning aggregate respectively. Various aggregates are known which can fulfill the required function, see e.g. DE-40-39 773, and EP-618 318. The cleaning module RM in the chute 8 and the cleaning aggregate in the card inlet zone now both can be connected to the card control system 120 (see also the FIG. 1) in such a manner that they can be set jointly or individually.

Setting can be effected e.g. according to EP-B-452 676 (and U.S. Pat. No. 5,181,195, respectively).

The chute 8 according to the FIG. 5 differs form the chute according to the FIG. 3 in that the lower chute portion 34 is not arranged in a vertical position but in an inclined position in such a manner that the lower end of the chute is located in the vicinity of the feed roll/feed trough unit (compare U.S. Pat. No. 5,623,749). Even if no transporting rolls 35 (FIGS. 2 and 3) are shown in the FIG. 5, they still could be provided for transporting the batt from the chute.

The air circulation through the lower chute portion 34 and the flock deposition zone at the roll 33 could be chosen substantially according to the arrangement shown in the FIG. 3, further description thus being dispensed with.

The upper chute portion 31 is to be arranged above the supply system 32 in such a manner that the fiber materials are reliably transported into the nip point between the feed roll 321 and the feed trough 321. The position of the chute portion 31 thus essentially is determined by the position of the supply system 32 relative to the roll 33.

The invention according to the present application also can be combined with the invention according to EP-A-801158 (and U.S. Ser. No. 08/824,604). The contents of EP-A-801158 thus herewith is considered integrated into the present application.

The cleaning module according to the present invention is applicable not only to a card chute. The same solution principles can be made use of in designing a "cleaning machine" for application in a conventional blowroom line, and therefore the further claims are not restricted to the combination with a batt-forming device.

If the present invention is applied to a fine cleaning machine, application of an opening roll of larger diameter becomes feasible. Whereas the roll 33 can be of a diameter ranging from 250 mm to 300 mm, an opening roll in a fine cleaning machine should be of a diameter exceeding 350 mm, of e.g. approximately 400 mm. The working width can be chosen in the range of 1 m to 1.5 m, and can be e.g. 1.2 m.

In a fine cleaning machine, it will be of importance that the circumference (the working surface) of the opening roll is made use of more intensely as it is possible or required in a filling chute as the fine cleaning machine is to be laid out for higher production rates (presently 500 to 600 kg/h). But in this case, it is not necessary to drop and deposit the material as it is carried on by a suction system known as such to the next machine in the processing line. The "outlet" of the cleaning module towards the suction system thus can be provided substantially below the supply system, which arrangement leaves much free room in the zone of the lower roll half for further separating elements (e.g. separating devices number 4, 5 and possibly 6). The cleaning elements provided in the zone of the lower half of the opening roll could be different compared to the separating devices 104, 106, 108 as in the zone of the lower half of the opening roll gravity assists the process of material separation, and trash elimination, respectively.

Compared to a conventional filling chute, the preferred embodiment according to the FIGS. 3A and 4B requires substantially more stringent demands as to the precision of the working elements and of the installation work. In the "cleaning module" according to the present invention the mutual position of a plurality of rotational axes must be ensured, namely of the opening roll 33, the feed roll 321 and the separating devices 104, 106, 108. Furthermore, the position of the feed trough must be adjustable with respect to the feed roll. The conventional filling chute represents a relatively simple structure of relatively simple design. The problem is rendered more difficult if the conventional working width of about 1,000 mm is increased (e.g.) to about 1,500 mm. Thus, obviously the conventional design layout of the chute must be reinforced.

The preferred solution for the latter task is based on the fact that the stability requirements have been increased only for the zone of the cleaning module but not for the adjacent chute portions. The preferred solution thus provides a cleaning module for application in a cleaning machine according to the present invention, in which the module comprises a support member for the working elements of the cleaner. The support member is characterized in that it is composed of lateral walls and of cross-ties, the wall thicknesses of which are chosen such as to ensure maintenance of the required mutual positioning of the working elements and ensure secure hold of the lateral walls and the cross-ties. The lateral walls can take up bearing elements in which the working elements are rotatably supported.

A module of such type can be connected to a base frame positioning the module at a suitable height level with respect to the card. This base frame preferentially comprises two columns each of which is co-ordinated to a lateral wall. Further elements of the chute can be mounted to the frame which substantially consists of the support member for the cleaning module and its base frame. Preferentially each of the columns is formed from sheet metal in which arrangement the sheet metal of each column is clamped between the corresponding lateral wall and the cross-ties in order to form a sandwich construction. The columns preferentially are rigidly connected additionally with the cross-ties e.g. by means of welds.

Figure 6:
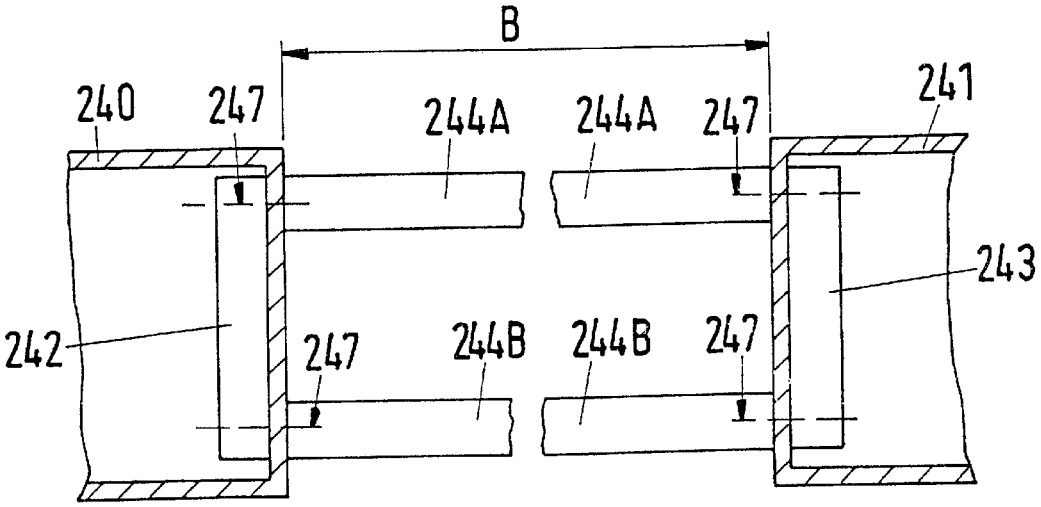
FIG. 6: a schematic view of the frame of a chute according to the present invention, seen from above.
Figure 7:
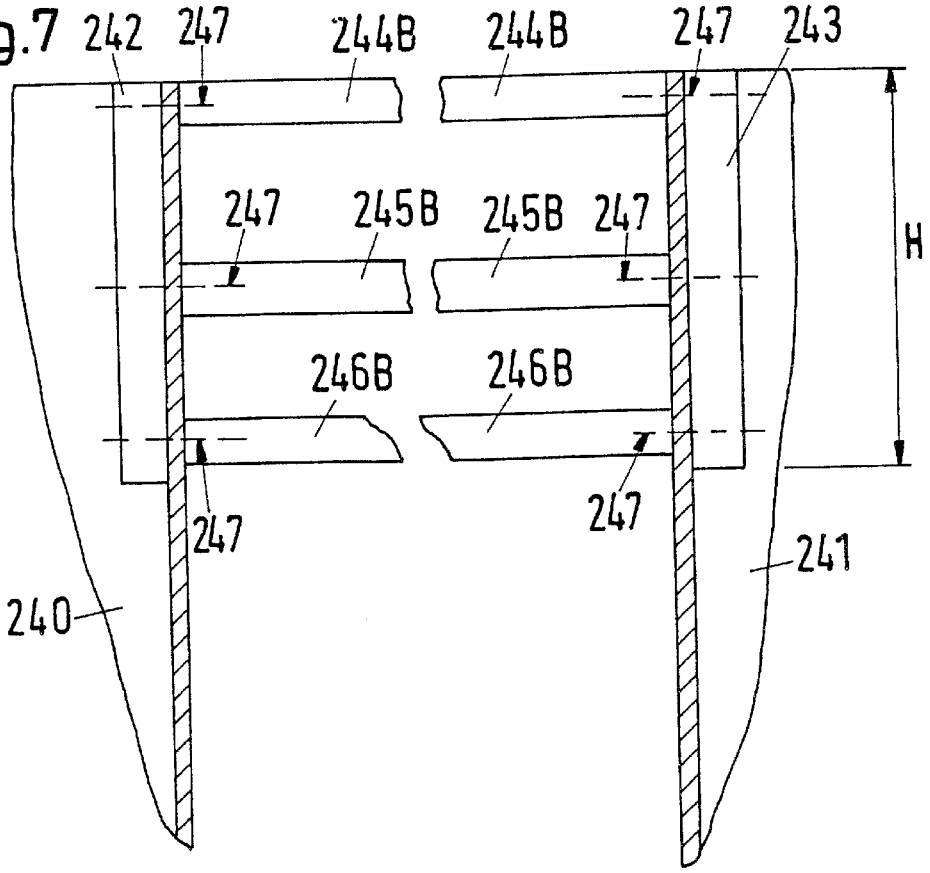
FIG. 7: a side view of the frame according to the FIG. 6.

A frame of this type is shown schematically in the FIGS. 6 and 7 in which illustrations the middle portions of the elements are left out as they do not contain essential details. The elements shown also are shown cut off where required for displaying the elements arranged below. The two columns, the left one and the right one, are indicated with the reference sign 240, 241. These columns can be formed from relatively thin sheet metal (e.g. 2 mm to 5 mm thick). The required kink resistance is obtained by suitably curving their cross-sections (to a U-shape as indicated in the FIG. 6, the shape not being relevant, however). The support member for the cleaning module comprises two lateral walls 242 and 243 and six cross-ties 244A and *b*, 245A and B and 246A and B (the cross-ties 244A, B only being visible in the FIG. 6, and the cross-ties 244B, 245B and 246B only being visible in the FIG. 7).

The lateral walls 242, 243 are made from relatively thick plate material (e.g 12 mm thick), but are of small dimension compared to the columns as their height H must be just sufficient to take up the working elements mentioned earlier. The lowest limit of this height H for a design solution according to the FIG. 3A is determined by the location of the rotational axis of the feed roll 321. The lateral walls 242, 243 are provided with bearings (not shown) in which the working elements according to the FIG. 3A are taken up.

The cross-ties 244, 245 and 246 determine the working width B. Preferentially they are rigidly connected to the columns 242, 241 (e.g. by welds, not shown). The lateral walls also are rigidly connected to the cross-ties as indicated schematically with broken lines at the points 247. These connections could be effected using e.g. bolts in such a manner that the relatively thin sheet metal of the columns 240, 241 is rigidly clamped between the cross-ties 244, 245, 246 and the lateral walls 242, 243 ("sandwich construction") which arrangement increases the strength of the columns 240, 241 in their critical zones.

The columns 240, 241 are parts of the base frame which determines the height level of the cleaning module with respect to the card (compare the FIG. 1, and the FIG. 5, respectively). This base frame can comprise further elements, e.g. foot portions, or a support member on rolls which ensures movability of the filling chute relative to the card.

It should be appreciated by those skilled in the art that various modifications and variations can be made in the present invention without departing from the scope and spirit of the invention. It is intended that the invention include such modifications and variations as come within the scope of the appended claims and their equivalents.

We claim:

1. A supply system for supplying fiber material to a textile carding machine, comprising:

a filling chute configured with said card machine, said filling chute comprising an upper supply chute section and a lower reserve chute section;

an opening roller disposed within said filling chute between said upper supply chute section and said lower reserve chute section;

a feed roll disposed relative to said opening roller so that a takeover point for fiber material transferred from said feed roll to said opening roller lies before and below a highest circumferential point of said opening roller in the direction of rotation thereof;

nip feed structure disposed relative to the circumference of said feed roll so as to define a nip feed arrangement for the fiber material before said takeover point in a direction of rotation of said opening roll;

at least two trash eliminating devices disposed above a horizontal plane through a rotational axis of said opening roller and after said feed roll and said takeover point in the direction of rotation of said opening roller, a first one of said trash eliminatng devices disposed adjacent said feed roll in the direction of rotation of said opening roller, said eliminating devices disposed relative to a circumferential surface of said opening roller so as to remove trash and debris from fiber material carried by said opening roller and to convey said trash and debris tangentially away from said opening roller; and said trash eliminating devices further comprising a pneumatic elimination system disposed to substantially immediately carry away said removed trash and debris such that said trash and debris is prevented from falling and collecting below said opening roller.

2. The supply system as in claim 1, further comprising at least three said eliminating devices all disposed above said horizontal plane of said opening roller axis.

3. The supply system as in claim 1, wherein each said eliminating device comprises an individual said pneumatic elimination system.

4. The supply system as in claim 3, wherein said pneumatic eliminating systems convey said trash and debris away generally in a direction parallel to said opening roller axis.

5. The supply system as in claim 1, wherein said eliminating devices comprise a trash separating element wherein all of said trash separating elements are jointly adjustable relative to said opening roller.

6. The supply system as in claim 1, wherein said eliminating devices comprise a trash separating element wherein each of said trash separating elements is individually adjustable relative to said opening roller.

7. The supply system as in claim 1, wherein said lower reserve chute section defines a fiber material batt forming device, and further comprising an air conveying system including a powered fan in communication with said lower reserve chute section to draw air through said fiber material batt forming device.

8. The supply system as in claim 7, wherein said air conveying system re-circulates air through said fiber batt forming device.

9. The supply system as in claim 8, further comprising a deflection zone defined between said lower reserve chute section and said opening roller, said air conveying system directing an air flow into said deflection zone generally in a conveying direction of fiber material from said opening roller into said lower reserve chute section.

10. A supply system for supplying fiber material to a textile carding machine, comprising:

a filling chute configured with said card machine, said filling chute comprising an upper supply chute section and a lower reserve chute section;

an opening roller disposed within said filling chute between said upper supply chute section and said lower reserve chute section;

feed roll disposed relative said opening roller so that a takeover point for fiber material transformed from said feed roll to said opening roller lies before and below a highest circumferential point of said opening roller in the direction of rotation thereof;

at least two trash eliminating devices disposed above a horizontal plane through a rotational axis of said opening roller and after said feed roll and said takeover point in the direction of rotation of said opening roller, said eliminating devices disposed relative to a circumferential surface of said opening roller so as to remove trash and debris from fiber material carried by said opening roller and to convey said trash and debris tangentially away from said opening roller;

said trash eliminating devices further comprising a pneumati elimination system disposed to substantially immediately carry away said removed trash and debris such that said trash and debris is prevented from falling and collecting below said opening roller; and wherein said air conveying system draws air from said deflection zone and through said fiber batt forming device, and re-circulates the air stream back to said deflection zone.

11. A supply system for supplying fiber material to a textile carding machine, comprising:

a filling chute configured with said card machine, said filling chute comprising an upper supply chute section and a lower reserve chute section;

a cleaning module disposed within said feed chute, said cleaning module further comprising:

an opening roller disposed within said filling chute between said upper supply chute section and said lower reserve chute section;

a feed roll disposed relative to said opening roller to define a takeover point for fiber material transferred from said feed roll to said opening roller;

at least one trash eliminating device disposed above a horizontal plane through a rotational axis of said opening roller, said eliminating device disposed relative to a circumferential surface of said opening roller so as to remove trash and debris from fiber material carried by said opening roller and to convey said trash and debris tangentially away from said opening roller; and said trash eliminating device further comprising a pneumatic elimination system disposed to substantially immediately carry away said removed trash and debris such that said trash and debris is prevented from falling and collecting below said opening roller;

a base frame supporting and determining the position of said cleaning module, said base frame comprising lateral walls and cross ties disposed between said lateral walls, said lateral walls having a thickness to support maintenance and positioning of said cleaning module; and columns coordinated with each said lateral wall, said columns formed from sheet metal clamped between said lateral walls, said cross ties rigidly connected to said lateral walls.

* * * * *